US005244764A

United States Patent [19]

Uno et al.

[11] Patent Number: 5,244,764

[45] Date of Patent: Sep. 14, 1993

[54] ELECTROSTATIC IMAGE-DEVELOPING TONER AND DEVELOPER

[75] Inventors: Mikio Uno, Odawara; Takashi Shintaku, Machida; Yoshihiro Kigami, Fujisawa; Takatsugu Takehara, Odawara, all of Japan

[73] Assignee: Mitsubishi Kasei Corporation, Tokyo, Japan

[21] Appl. No.: 883,789

[22] Filed: May 15, 1992

[30] Foreign Application Priority Data

May 20, 1991 [JP] Japan ..... 3-114944

[51] Int. Cl.[5] ..... G03G 9/09; G03G 9/097

[52] U.S. Cl. ..... 430/106; 430/110

[58] Field of Search ..... 430/106, 106.6, 110

[56] References Cited

FOREIGN PATENT DOCUMENTS 105157 5/1987 Japan ..... 430/110
2-166461 6/1990 Japan .
3-7949 1/1991 Japan .
3-27050 2/1991 Japan .
3-103866 4/1991 Japan .
174544 7/1991 Japan ..... 430/110
3-236064 10/1991 Japan .
3-245158 10/1991 Japan .

*Primary Examiner*—Roland Martin
*Attorney, Agent, or Firm*—Oblon, Spivak, McClelland, Maier & Neustadt

[57] ABSTRACT

Disclosed herein is an electrostatic image-developing toner comprising particles of a toner precursor particles composed of at least a resin and a colorant, and powder of a compound represented by the following formula (I):

$$M^1y_1.M^2y_2.M^3x.(OH)_2.Ax/n.mH_2O \quad (I)$$

(wherein $M^1$ is at least one of the divalent metals selected from the group consisting of Mg, Ca, Sr and Ba; $M^2$ is at least one of the divalent metals selected from the group consisting of Zn, Cd, Pd and Sn; $M^3$ is a trivalent metal; A is an anion of n valency; x, yl, yz and m are the positive numbers satisfying the relations of $0<x\leqq 0.5$, $y_1+y_2=1-x$ and $0\leqq m<2$).

19 Claims, 2 Drawing Sheets

ELECTROSTATIC IMAGE-DEVELOPING TONER AND DEVELOPER

BACKGROUND OF THE INVENTION

The present invention relates to an electrostatic image-developing toner and a developer containing the same, used for developing electrostatic latent images formed in electrophotography method, electrostatic recording method, etc. More particularly, the present invention relates to a positively charged electrostatic image-developing toner and a negatively charged electrostatic image-developing toner, both of which contain specific materials.

The developer used for electrocopiers, etc. is once deposited on an image carrier such as a photoreceptor on which an electrostatic image has been formed, in the developing step, then the deposited developer is transferred from the photoreceptor to a transfer sheet in the transfer step, and the transferred developer is finally fixed on a copying paper in the fixing step. As the developer used for developing the electrostatic image formed on a latent image carrier, there are known two-component developer comprising a carrier and a toner, and one-component developer (magnetic toner and non-magnetic toner) which requires no carrier.

As a toner contained in the said developer, there can be mentioned a positively charged toner and a negatively charged toner. As the agents for imparting charge to the positively charged toner, there have been known the charge-imparting or controlling agents which are added to the toner, such as Nigrosine dyes and quaternary ammonium salts, and the coating agents which can impart desired charge to the carrier. On the other hand, as the agents for imparting negative charge, there have been known the charge-imparting agents such as metallized azo dyes, a fine inorganic powder, a fine organic powder and carrier-coating agents.

However, any of these conventional charge-imparting agents was not always satisfactory in their charge-imparting effect, and it has been difficult to obtain a toner which shows proper charging property stably without being affected by the environmental factors and also exhibits a favorable change of charge with the passage of time. Especially, the toner containing the conventional charge-imparting agent mentioned above has the problem that it causes an image blotting due to increase of a background (BKG) level in continuous copying operation under a high temperature and high humidity condition, making it unable to obtain a stabilized copy density.

The toner in the electrostatic image developer is stirred in use and as a result, the toner is frictionally charged through contact with carrier or charging medium such as charging blade. In this process, in the case of the positively charged toner, a binder resin as a main component of the toner, except for certain types of resin, has a strong tendency to get negatively charged, so that it is hard to obtain a positively charged toner which exhibits always constant and sufficient charging performance. At starting the use of developer or at re-starting the use of the developer after allowing to stand for long-time, the build-up of charge at the start of stirring of the developer is bad, and electrostatic attraction between the toner and the said charging medium becomes insufficient, thereby causing scatter of the toner in the apparatus. Such phenomenon of toner scattering due to slow the build-up of charge of toner becomes conspicuous especially under a high temperature and/or high humidity condition.

In the case of the negatively charged toner having negative polarity of charge against the carrier, the toner components adhere to the carrier particle surfaces, thereby reducing the charge-imparting effect of the carrier, so that the amount of charge on the toner particles decreases gradually as the copying operation is repeated, and finally the toner particles become positively charged. Since the toner particles are not attracted strongly to the electrostatic latent image, the toner particles may deposit on other part than the latent image on the photoreceptor to cause staining of the image. Also, some of the toner particles may be scattered from the photoreceptor into the copying machine.

For solving these problems, there has been proposed a developing toner prepared by adding a basic magnesium aluminum hydroxycarbonate hydrate powder which is composed of a compound analogous to that of the present invention, to the toner particles (Japanese Patent Application Laid-Open (Kokai) Nos. 7949/91, 27050/91 and 103866/91).

A developing toner has been also proposed in which, in order to enhance an ozone resistance of the photoreceptor, a hydrotalcite compound which is analogous to the compound of the present invention, is added to the toner particles (Japanese Patent Application Laid-Open (Kokai) No. 166461/90).

These proposed developing toners, however, have the problem of environment dependency of image density, that is, a phenomenon that the image density is lowered under a low temperature and low humidity condition, which makes it hard to obtain a stabilized image density.

As a result of strenuous studies for overcoming these problems, it has been found that by adding a compound represented by the following formula (I) to the toner particles, the obtained electrostatic image-developing toner shows a good charging property and little environment dependency of image density.

$$M^1y_1.M^2y_2.M^3x.(OH)_2.Ax/n.mH_2O \quad (I)$$

(wherein $M^1$ is at least one of the divalent metals selected from the group consisting of Mg, Ca, Sr and Ba; $M^2$ is at least one of the divalent metals selected from the group consisting of Zn, Cd, Pb and Sn; $M^3$ is a trivalent metal; A is an anion of n valency; n is integer of 1 to 4; and x, $y_1$, $y_2$ and m are the positive numbers satisfying the relations of $0<x\leqq 0.5$, $y_1+y_2=1-x$ and $0\leqq m<2$).

The present invention has been attained on the basis of such finding.

SUMMARY OF THE INVENTION

In a first aspect of the present invention, there is provided an electrostatic image-developing toner comprising a toner precursor particles composed of at least a resin and a colorant, and a powder of a compound represented by the following formula (I):

$$M^1y_1.M^2y_2.M^3x.(OH)_2.Ax/n.mH_2O \quad (I)$$

(wherein $M^1$ is at least one of the divalent metals selected from the group consisting of Mg, Ca, Sr and Ba; $M^2$ is at least one of the divalent metals selected from the group consisting of Zn, Cd, Pb and Sn; $M^3$ is a trivalent metal; A is an anion of n valency; n is integer of 1 to 4; and x, $y_1$, $y_2$ and m are the positive numbers satisfying the relations of $0<x\leqq 0.5$, $y_1+y_2=1-x$ and $0\leqq m<2$).

In a second aspect of the present invention, there is provided a developer comprising the developing toner defined in the 1st aspect.

An object of the present invention is to provide an electrostatic image-developing toner which is capable of providing a high image density, has a good stability and little risk of the toner scattering, can minimize the image blotting due to increase of the BKG level, and is excellent in life stability.

Another object of the present invention is to provide an electrostatic image-developing toner which can provide an excellent image quality, can minimize change of image quality with passage of time and an environment dependency of image density, and has an excellent charging characteristics.

Still another object of the present invention is to provide an electrostatic image-developing toner which is excellent in storage stability regardless of environmental factors such as temperature and humidity at the place of use or storage, and can minimize environment dependency against change of image or image quality.

DETAILED DESCRIPTION OF THE INVENTION

Figure 1:
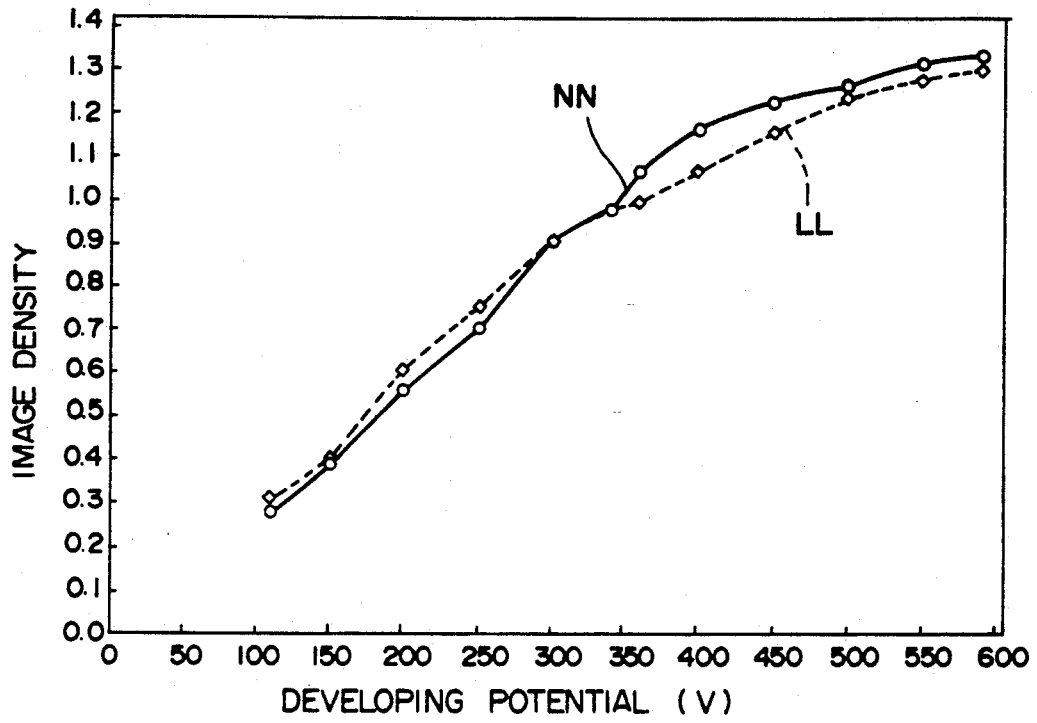
FIG. 1 is a graph showing the relation between developing potential and image density in use under a normal environment, and in use under a low temperature and low humidity environment in the embodiment described in Example 14.

As the resin component of the toner particles according to the present invention, there can be used various known types of resin which are suitable for the component of electrostatic image-developing toner. For example, there can be used styrene resins (homopolymers or copolymers containing styrene or styrene substituents) such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-acrylic ester copolymers (such as styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylic ester copolymers (such as styrene-methyl methacrylate copolymer, styrene-ethyl methacrylate copolymer, styrene-butyl methacrylate copolymer and styrene-phenyl methacrylate copolymer), styrene-α-chloromethyl acrylate copolymer and styrene-acrylonitrile-acrylic ester copolymers; vinyl chloride resins; rosin-modified maleic acid resins; phenol resins; epoxy resins; saturated or unsaturated polyesters; polyethylenes; polypropylenes; ionomer resins; polyurethane; silicone resins; ketone resins; ethylene-ethyl acrylate copolymer; xylene resins; polyvinylbutyral resins; and polycarbonate resins. Among them, styrene resins, saturated or unsaturated polyesters and epoxy resins are especially preferred for use in the present invention. The said resins may be used either singly or in mixtures.

It is also possible to use the crosslinked binder resins disclosed in Japanese Patent Publication (Kokoku) No. 23354/76 and Japanese Patent Application Laid-Open (Kokai) No. 44836/75 and the non-crosslinked binder resins disclosed in Japanese Patent Publication (Kokoku) Nos. 6895/80 and 32180/88.

It is desirable that the glass transition temperature of the binder resin for the said toner particles is 50° C. or more at the start of transition (inflection point) as measured by a differential thermal analyzer. If the glass transition temperature of the binder resin is less than 50° C., when the toner is left under a temperature of not less than 40° C. for a long time, there may take place agglomeration or cohesion of the toner particles, thereby giving rise to the problems in practical use.

The colorant used for the toner particles in the present invention is not limited to the specific types. There can be used any suitable one of the commonly used pigments or dyes. For example, there can be used titanium oxide, zinc white, alumina white, calcium carbonate, prussian blue, carbon black, phthalocyanine blue, phthalocyanine green, Hansa Yellow G, Rhodamine dyes, Chrome Yellow, quinacridone, Benzidine Yellow, Rose Bengale, triallylmethane dyes, anthraquinone dyes, and monoazo and diazo dyes. These colorants may be used either singly or in mixtures to provide a desired toner color.

The colorant may be contained in any suitable amount for coloring the toner so that a visible image may be formed by development. Usually the content of the colorant is preferably 3–20 parts by weight based on 100 parts by weight of the binder resin.

It is also possible to add a small amount of an auxiliary or auxiliaries for the purpose of improving thermal and physical properties of the toner. As such auxiliary, there can be used, for instance, polyalkylene wax, paraffin wax, higher fatty acids, fatty acid amides, metal soap and the like. The amount of the auxiliary or auxiliaries added is preferably 0.1–10 parts by weight based on 100 parts by weight of the toner particles.

In the case of the positively charged toner, it is not always necessary to contain a positive charge-imparting agent when a resin having a strong tendency to charge positively, such as styrene-diethylaminoethyl methacrylate copolymer, is used as the binder resin. But it is preferable to contain a positive charge-imparting agent according to the required charging performance depending on the kind of photoreceptor, apparatus such as developing tank and carrier used, as the ordinarily used positively charged toner.

The positive charge-imparting agent used in the present invention can be selected from materials including quaternary ammonium salts, triphenylmethane compounds, Nigrosine dyes, imidazole derivatives and metal complexes thereof. Concrete examples of the above-mentioned charge-imparting agents are shown below.

(1) Quaternary ammonium salts

Examples of the quaternary ammonium salts usable as positive charge-imparting agent in the present invention include the salt-forming compounds disclosed in Japanese Patent Publication (Kokoku) Nos. 54694/89, 54695/89 and 54696/89, and compounds represented by the following formulae (II) and (III) (which are disclosed in U.S. application, Ser. No.07/757,211 filed Sep. 10, 1991, U.S. application Ser. No.(unknown) filed Apr. 28, 1992 and European Patent Application No.92303889.7):

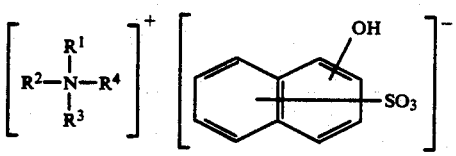

(II)

(wherein $R^1$, $R^2$, $R^3$ and $R^4$ each represents a substituted or non-substituted alkyl group, preferably a substituted or non-substituted alkyl group having 1 to 18 carbon atoms, or a substituted or non-substituted aralkyl group, preferably a substituted or non-substituted aralkyl group having 7 to 15 carbon atoms.)

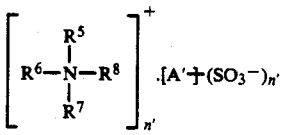

(III)

(wherein $R^5$ and $R^7$ are each a substituted or non-substituted alkyl group, preferably a substituted or non-substituted alkyl group having 1 to 8 carbon atoms, or a substituted or non-substituted aralkyl group, preferably a substituted or non-substituted aralkyl group having 7 to 15 carbon atoms; $R^6$ and $R^8$ are each a substituted or non-substituted alkyl group, preferably a substituted or non-substituted alkyl group having 1 to 30 carbon atoms, or a substituted or non-substituted aralkyl group, preferably a substituted or non-substituted aralkyl group having 7 to 15 carbon atoms; A' represents a benzene ring which may have a substituent(s) or a naphthalene ring which may have a substituent(s), and n' is 2 or 3.)

(2) Triphenylmethane compounds

The compounds disclosed in Japanese Patent Application Laid-Open (Kokai) No. 11455/76 and Japanese Patent Publication (Kokoku) No. 57787/88 and (Kohyo) No. 501506/90 can be mentioned as examples of the triphenylmethane compounds in the present invention.

(3) Nigrosine dyes

The Nigrosine dyes usable as the said agent in the present invention include Bontron N-Series, Orient-Spilone Black AB, Orient-Spilone Black SB, Orient Black BS, Solvent Black #5, Nigrosine Base EX and Solvent Black #7 (produced by Orient Chemical Co., Ltd.); Spirit Black No. 850 and Spirit Black No. 900 (produced by Sumitomo Chemical Co., Ltd.).

(4) Imidazoles (imidazole derivatives or metal complexes of imidazoles)

The compounds disclosed in Japanese Patent Application Laid-Open (Kokai) Nos. 119364/91, 202856/91, 217851/91, 217852/91 and 217853/91 can be cited as examples of the imidazoles in the present invention.

The negatively charged toner may contain a known charge controlling agent such as metallized azo dyes containing Cr, Co or the like and salicylic or alkylsalicylic acid metal complex dyes containing Cr, Al, Zn or the like, according to the required charging performance depending on the kind of copying machine, carrier, etc.

Usually, it is preferable that the said charge controlling agent has an average particle size in the range of 0.01–10 μm, more preferably 0.1–5 μm.

As means for containing the said charge controlling agent in the toner, there are known a method in which the said agent is added internally to the toner and a method in which the said agent is added externally to the toner. In the internal addition, the amount of the compound used is usually in the range of 0.05–20 parts by weight, preferably 0.1–10 parts by weight, based on 100 parts by weight of the said binder resin. In the external addition, the amount of the compound used is preferably 0.01–10 parts by weight based on 100 parts by weight of the binder resin.

The electrostatic image-developing toner according to the present invention contains a specific compound represented by the formula (I) together with the toner particles.

The compounds represented by the formula (I) are thermally stable as compared with other analogous compounds, so that the toner containing powder of the compound represented by the formula (I) has the heat-resisting properties which are advantageous in heat treatments, and long-time storage and use under high temperature. Further, such a toner has little environment dependency and especially is capable of minimizing change of image density under a low temperature and/or low humidity condition and also providing excellent image stability.

In the above formula (I), $M^1$ is at least one of the divalent metals selected from the group consisting of Mg, Ca, Sr and Ba. Preferred examples are Mg, Ca, Mg plus Ca, Mg plus Sr, and Mg plus Ba. Mg or Mg and Ca is more preferred.

$M^2$ in the formula (I) is at least one of the divalent metals selected from the group consisting of Zn, Cd, Pb and Sn. Preferred examples are Zn, Cd, Pb and Zn plus Cd. Zn and/or Cd is more preferred.

$M^3$ in the formula t metal. Preferred examples are Al, Bi, In, Sb, B and Ti. Among them, Al is more preferred.

A in the formula (I) is an anion of n valency, such as $CO_3^{2-}$, $OH^-$, $HCO_3^-$, salicylic acid ion$^-$, citric acid ion$^{3-}$, $NO_3^-$, $I^-$, $(OOC—COO)^{2-}$ and $(Fe(CN)_6)^{4-}$. Among them, $CO_3^{2-}$ and $OH^-$ are more preferred.

Also in the formula (I), x is a positive number defined by $0<x\leqq 0.5$, preferably $0.2\leqq x\leqq 0.5$, more preferably $0.2\leqq x\leqq 0.4$, most preferably $0.25\leqq x\leqq 0.35$. $y_1$ and $y_2$ are each a positive number and defined as $y_1+y_2=1-x$. Preferred is $y_1\geqq y_2$, more preferably $y_1>y_2$. m is also a positive number specified by $0\leqq m<2$. For obtaining a compound of the formula (I) wherein m is 0 or a number close to 0, it is preferred to subject a crystal water-removing treatment.

The compound represented by the formula (I) used in the present invention has a crystal particle size of preferably about 0.1 to about 1 μm and a BET specific surface area of preferably not more than about 50 $m^2/g$, more preferably not more than about 30 $m^2/g$. Also, the average secondary particle size of the said compound is preferably not more than about 5 μm, more preferably not more than about 2 μm, most preferably about 0.05 μm to about 1 μm.

When the compound represented by the formula (I) is added internally to the toner particles, compatibility and dispersibility in relation to the resin are improved.

When the compound is added externally, it is recommended to use the compound particles subjected to surface treatment since this enables further to improve the effects of the developing toner of the present invention.

As the surface-treating agent, there can be used, for instance, higher fatty acids such as stearic acid, oleic acid and lauric acid; anionic surfactants such as sodium stearate, sodium oleate and sodium laurylbenzenesulfonate; silane or titanate coupling agents such as vinyltriethoxysilane, γ-methacryloxypropyl-triethoxysilane, isopropyltriisostearoyl titanate and isopropyltridecylbenzenesulfonyl titanate; and esters of glycerin and fatty acids such as glycerin monostearate and glycerin monooleate. The higher fatty acids are preferred.

Regarding the surface treatment of the compound represented by the formula (I) with the surface-treating agent mentioned above, in case where the surface-treating agent is liquid in itself or it is dissolved in, for instance, water or an alcohol to form a solution, the surface treatment can be accomplished by mechanically mixing such liquid surface-treating agent and powder of the compound represented by the formula (I) or an aqueous suspension thereof under heating or without heating. When the surface-treating agent is dissolved under heating, the surface treatment can be conducted by mechanically mixing the surface-treating agent with the compound represented by the formula (I) under heat-dissolving condition. After sufficient mixing-treatment, the treated powder may be optionally subjected to suitable operations such as washing with water, dehydration, drying, grinding, classifying, etc., to obtain the desired surface-treated powder.

The content of the surface-treating agent in the thus obtained surface-treated powder may be optionally changed, but usually it is in the range of about 0.1 to about 10 parts by weight based on 100 parts by weight of the compound represented by the formula (I).

The compound represented by the formula (I) can be produced by a known method, for example, the method disclosed in U.S. Pat. No.3,539,306, except for jointly using at least one of the substances equivalent to $M^1$ and at least one of the substances equivalent to $M^2$. Also, the compound represented by the formula (I) having a BET specific surface area of about 30 $m^2/g$ or less and an average secondary particle size of about 5 μm or less can be obtained by subjecting the compound represented by the formula (I) produced in the manner described above to an additional heat-treatment in an aqueous medium. For example, the compound represented by the formula (I) produced by the method mentioned above is subjected to heat-treatment in an aqueous medium in an autoclave at a temperature of about 120° C. to about 250° C. for about 5 to about 40 hours, thereby obtaining the compound represented by the formula (I) having a BET specific surface area of about 30 $m^2/g$ or less and an average secondary particle size of about 5 μm or less. The heat-treatment can be accomplished by conducting the autoclaving treatment under pressure until the desired BET specific surface area and average secondary particle size are provided. It is preferable to conduct the annealing (or heat treatment) at as high a temperature as possible.

Typical examples of the compounds represented by the formula (I) are shown below ((1)-(21)):

$$Mg_{0.5}Zn_{0.17}Al_{0.33}(OH)_2(CO_3)_{0.165}.0.45H_2O \quad (1)$$

$$Mg_{0.55}Zn_{0.15}Al_{0.3}(OH)_2(CO_3)_{0.15} \quad (2)$$

$$Mg_{0.1}Ca_{0.3}Zn_{0.3}Al_{0.3}(OH)_2\left(\begin{matrix}CHCOO\\ \|\\ CHCOO\end{matrix}\right)_{0.15}.0.41H_2O \quad (3)$$

$$Mg_{0.6}Cd_{0.1}Al_{0.3}(OH)_2(CH_3COO)_{0.3}.0.34H_2O \quad (4)$$

$$Mg_{0.50}Pb_{0.20}Al_{0.30}(OH)_2(CO_3)_{0.15}.0.52H_2O \quad (5)$$

$$Mg_{0.50}Zn_{0.18}Al_{0.32}(OH)_2(CO_3)_{0.16} \quad (6)$$

$$Mg_{0.38}Zn_{0.30}Al_{0.32}(OH)_2(CO_3)_{0.16}.0.2H_2O \quad (7)$$

$$Mg_{0.60}Zn_{0.14}Al_{0.26}(OH)_2(CO_3)0.13 \quad (8)$$

$$Mg_{0.60}Zn_{0.20}Al_{0.20}(OH)_2(CO_3)_{0.10}.0.6H_2O \quad (9)$$

$$Mg_{0.50}Zn_{0.20}Al_{0.30}(OH)_2(NO_3)_{0.30} \quad (10)$$

$$Mg_{0.5}Zn_{0.20}Al_{0.30}(OH)_2(OOCH{=}CHCOO)_{0.15} \quad (11)$$

$$Mg_{0.1}Ca_{0.4}Zn_{0.2}Al_{0.30}(OH)_{2.3}.0.25H_2O \quad (12)$$

$$Mg_{0.52}Zn_{0.16}Al_{0.32}(OH)_2(CO_3)_{0.16}.0.50H_2O \quad (13)$$

$$Mg_{0.48}Zn_{0.18}Al_{0.34}(OH)_2(CO_3)_{0.17} \quad (14)$$

$$Mg_{0.15}Ca_{0.4}Zn_{0.15}Al_{0.3}(OH)_{2.3}.0.2H_2O \quad (15)$$

$$Mg_{0.45}Zn_{0.23}Al_{0.32}(OH)_2(CO_3)0.16 \quad (16)$$

$$Mg_{0.60}Zn_{0.16}Al_{0.24}(OH)_2(CO_3)0.12 \quad (17)$$

$$Mg_{0.50}Zn_{0.25}Al_{0.25}(PH)_2(CO_3)_{0.125} \quad (18)$$

$$Mg_{0.48}Zn_{0.20}Al_{0.32}(OH)_2(CO_3)0.16 \quad (19)$$

$$Mg_{0.5}Zn_{0.18}Al_{0.32}(OH)_2(CO_3)_{0.16} \quad (20)$$

$$Mg_{0.6}Zn_{0.2}Al_{0.2}(OH)_2(CO_3)_{0.1} \quad (21)$$

The compounds represented by the formula (I) according to the present invention have the effect of improving the charging characteristics of the toner and are especially effective for promoting rise of charge at the starting of use of the developer or at the resuming of its use.

In the present invention, the compound represented by the formula (I) is used in an amount of 0.001-1 part by weight, preferably 0.01-1 part by weight based on 100 parts by weight of the toner particles.

Also, the developing toner of the present invention may be added with specific fine inorganic powder having a prescribed BET specific surface area. The content of such inorganic powder added in the toner is preferably 0.005-7 parts by weight, more preferably 0.01-5 parts by weight based on 100 parts by weight of the toner. If its content is less than 0.005 parts by weight, the sufficient fluidity-improving effect of the inorganic powder can not be expected, while if the content of the inorganic powder exceeds 7 parts by weight, it tends to cause troubles such as deterioration of charging activity, etc. due to filming of the photoreceptor by the freed inorganic powder and adhesion of the powder to the carrier. Further, in the case of the positively charged toner, a sharp reduction of the amount of charge may be induced to cause worsening of the BKG level and encouragement of scattering of toner. In the case of the negatively charged toner, there may be induced a sharp rise of the amount of charge to cause lowering image density.

The specific inorganic fine powder acts as a fluidity improver for the toner, and also serves for improving a storage stability and a supplemental performance of the toner as well as a mobility of the developer to improve the image characteristics. The nitrogen-adsorbed BET specific surface area of the said inorganic fine powder is preferably in the range of 50 to 500 $m^2/g$. If the specific surface area is less than 50 $m^2/g$, it is difficult to give a satisfactory fluidity improving effect for the toner, and if the specific surface area exceeds 500 $m^2/g$, the bulkhead effectiveness between the toner particles is reduced to cause agglomeration or cohesion of the toner particles in storage under high temperature.

As the inorganic fine powder, there can be used one or more of pulverized silica, titanium and alumina produced by a conventional wet process or dry process. Silica is more preferred.

It is also preferable that the inorganic fine powder be subjected to a hydrophobic-treatment with a surface-treating agent for improving environment dependency of the toner mixed with the said powder. As the surface-treating agent, there can be used silane coupling agents, titanate coupling agents, higher fatty acids, anionic surfactants, silicone oils and the like. The silane coupling agents and silicone oils are preferred from the viewpoint of hydrophobicity and charging characteristics. The silane coupling agents are more preferred in view of the improvement of the environment dependency and fluidity of the toner.

The use of the silane coupling agents as surface-treating agent for the inorganic fine powder is more effective for giving a hydrophobic activity to the inorganic powder and also conduces to an excellent fluidity-improving effect of inorganic powder.

Conventional methods can be used for the surface-treatment of the inorganic fine powder with a silane coupling agent. As the silane coupling agent, there can be used, for instance, organoalkoxysilanes (methoxytrimethylsilane, dimethoxydimethylsilane, trimethoxymethylsilane, ethoxytrimethylsilane, etc.), organochlorosilane (trichloromethylsilane, dichlorodimethylsilane, chlorotrimethylsilane, trichloroethylsilane, dichlorodiethylsilane, chlorotriethylsilane, trichlorophenylsilane, etc.), organosilazanes (triethylsilazane, tripropylsilazane, triphenylsilazane, hexamethyldisilazane, hexaethyldisilazane, hexaphenyldisilazane, etc.), organodisilanes and organosilanes. These silane coupling agents may be used either singly or in a mixture thereof. Among these silane coupling agents, organochlorosilanes and organosilazanes are preferred.

Known methods can be also used for the surface-treatment of the inorganic fine powder with a silicone oil. As the silicone oil in this treatment, there can be used ordinary straight silicone oils such as dimethylsilicone oil, methylphenylsilicone oil, methylhydrogensilicone oil, etc.; and modified silicone oils such as methacryl-modified silicone oil, alkyl-modified silicone oil, epoxy-modified silicone oil, amino-modified silicone oil, etc. These silicone oils may be used either singly or in a mixture thereof. The straight silicone oils are preferred.

As a resistance regulating agent or a polishing agent, known inorganic fine powder, organic fine powder, etc., may be mixed as external additives in the developing toner of the present invention in an appropriate amount, preferably 0.005–5 parts by weight based on 100 parts by weight of the toner.

In case of using the toner of the present invention for a two-component developer, the said toner is properly mixed with a magnetic carrier. In this case, the content of the toner of the present invention is preferably 1–10 parts by weight, more preferably 2 to 8 parts by weight based on 100 parts by weight of the carrier.

As the magnetic carrier, there can be used the known carrier materials such as iron powder, ferrite powder, magnetite powder, magnetic resin carrier, etc., having a particle size of about 20 to 200 μm. It is also preferred to use a coated magnetic carrier prepared by coating on the surfaces of the carrier particles with a coating resin such as silicone resin, acrylic resin, fluorine resin, styrene resin, etc., or a mixture of these resins.

A developer prepared by mixing a positively charged toner and a carrier coated with a fluorine or silicone-group resin is particularly useful. As the coated carrier, a ferrite powder of which at least upper surface thereof is coated with a silicone-group resin is more preferred.

The toner of the present invention can be also used as a one-component magnetic or non-magnetic toner in which no carrier is added.

Various methods are available for the preparation of a toner precursor of the present invention. In a generally employed process, the materials such as resin, colorant, wax, charge-controlling agent, etc., are uniformly mixed and dispersed by a mixer, and the resultant mixture is melt kneaded by an enclosed kneader or a single- or twin-screw extruder, then cooled, pulverized and classified. As for the kneading means, a single- or twin-screw extruder is popularly used recently for its advantages such as capability of continuous production. For example, twin-screw extruder Model KTK (manufactured by Kobe Steel, Ltd.), extruder Model TEM (manufactured by Toshiba Machine Co., Ltd.), twin-screw extruder (manufactured by K.C.K. Corp.), twin-screw extruder Model PCM (manufactured by Ikegai Ironworks Co., Ltd.) and Ko-kneader (manufactured by Buss Corp.) are usable.

The average particle size of the toner in the present invention is preferably in the range of 3 to 20 μm.

In case of externally adding the additives to the toner, the classified toner and the additives are mixed with stirring by a high-speed stirrer such as a supermixer or Henschel mixer. If necessary, the kind and amount of the starting toner for developer and the supplementary toner may be changed properly.

The toner of the present invention can be obtained by adding powder of a compound represented by the formula (I) and an inorganic fine powder to the toner precursor described above and mixing them with stirring. The mixing conditions such as stirring speed, time, etc., may be properly selected in conformity to the desired toner performance. It is recommended to subject the inorganic powder to a crushing treatment before being applied to the external addition work for minimizing the chance of agglomeration of the particles.

A two-component developer can be produced by mixing and stirring the toner of the present invention obtained by the process described above and a carrier in a suitable mixing machine such as ball mill, V-type mixer, etc., for a predetermined period of time.

The BET specific surface area of the inorganic fine powder can be measured by a commercially available BET specific surface area measuring apparatus using nitrogen adsorption. A typical example of such apparatus is an automatic flow type specific surface area meter (Flow-Sorb Model 2300) manufactured by Shimadzu Corp.

The electrostatic image-developing toner of the present invention shows always moderate and stabilized charging performance, and also maintains moderate fluidity, so that it is excellent in storage stability and image stability. Further, it can maintain high and stabilized image density even in a copying operation under a low temperature and low humidity condition, and has high reliability against environmental dependency. Thus, the present invention provides a considerable amount of industrial benefit.

EXAMPLES

The present invention will hereinafter be described in further detail by showing the examples thereof. It is to be understood, however, that these examples are merely intended to be illustrative and not to be construed as limiting the scope of the invention.

In the following descriptions of the Examples, all "parts" are "part by weight" unless otherwise noted.

Example 1

100 parts of a styrene resin (styrene-n-butyl acrylate copolymer; styrene/n-butyl acrylate monomeric weight ratio=82/18), 2 parts of Bontrone P-51 [produced by Orient Chemical Co., Ltd., belonging to the compounds represented by the formula (II)] which is a charge controlling agent of a quaternary ammonium salt, 5 parts of Carbon Black #40 (produced by Mitsubishi Kasei Corp.) and 2 parts of Viscol 550P (produced by Sanyo Chemical Co., Ltd., a low-molecular weight polypropylene) were blended, kneaded, pulverized and classified to obtain a black toner having an average particle size of 11 μm.

To 100 parts of the thus-obtained black toner were added and mixed 0.2 parts of fine silica powder (R-972, produced by Nippon Aerosil Co., Ltd.) and 0.3 parts of fatty acid-treated powder of the compound (1) (BET specific surface area: 15 $m^2/g$; average secondary particle size: 0.2 μm) by a Henschel mixer.

4 parts of the thus-obtained toner and 100 parts of a ferrite carrier having an average particle size of about 100 μm and coated with a silicone resin were mixed and stirred to form a developer.

This developer was subjected to 100,000-sheets copying test under a high temperature (40–45° C.) and high humidity (85–90% RH) condition by using a copying machine using an organic photoconductor as photoreceptor.

A toner of the same composition as the toner used for the said developer was used as a supplementary toner in the copying test.

As a result of the test, there was noted no increase of the BKG level of the copy, and uniformity and density of the solid black of the copy were high even after copying 100,000 sheets. As a result, the tested toner and developer unchanged in density and showed an excellent durability even in use under a severe environment of high temperature and high humidity.

Example 2

A toner and a developer were prepared in the same way as Example 1 except that the amount of the fatty acid-treated powder of the compound (1) was changed to 0.5 parts, and they were subjected to the same 100,000-sheets copying test as Example 1. As a result, there was seen no increase of the BKG level and the solid black of the copy had a high uniformity and density. Also, these toner and developer unchanged in density and showed an excellent durability in the test.

Example 3

A toner and a developer were prepared in the same way as Example 1 except that the amount of the fatty acid-treated powder of the compound (1) was changed to 0.1 part. There is no increase of the BKG level, and the solid black of the copy had a high uniformity and density even after copying 100,000 sheets, indicating an excellent durability of these toner and developer.

Example 4

A toner and a developer were prepared in the same way as Example 1 except for use of 0.5 parts of fine powder of the compound (1) which had no fatty acid-treatment, and they were subjected to the same 100,000-sheets copying test as Example 1. No increase of the BKG level was noted and the solid black of the copy had a high uniformity and density even after the 100,000-sheets copying test. Also, the said toner and developer unchanged in density and showed an excellent durability.

Example 5

A toner and a developer were prepared in the same way as Example 1 except that the amount of the charge controlling agent was changed to 5 parts. In the 100,000-sheets copying test with these toner and developer, there was seen no increase of the BKG level and the solid black of the copy had a high uniformity and density. Also, these toner and developer unchanged in density throughout the test and showed an excellent durability.

Example 6

A toner and a developer were obtained by following the same procedure as Example 1 except that polyester resin A (a polyester mainly composed of Po adduct of bisphenol A and terephthalic acid) was used in place of styrene resin. In the 100,000-sheets copying test, these toner and developer had no increase of the BKG level, and the solid black of the copy had a high uniformity and showed an excellent durability.

Example 7

100 parts of polyester resin A, 3 parts of Rhodamine B (xanthene dye; C.I. Solvent Red 49) and 2 parts of a charge controlling agent comprising a quaternary ammonium salt were blended, kneaded, pulverized and classified to obtain a magenta toner having an average particle size of 11 μm.

To 100 parts of this magenta toner were externally added 0.2 parts of fine silica powder (R-972, produced by Nippon Aerosil Co., Ltd.) and 0.3 parts of fatty acid-treated powder of the compound (1). 4 parts of the thus-obtained toner and 100 parts of a ferrite carrier having an average particle size of about 100 μm and coated with a silicone resin were mixed and stirred to form a developer.

This developer was subjected to the same copying test as Example 1. There took place no increase of the BKG level, and the copy density and uniformity were high even after copying 100,000 sheets.

Example 8

A toner and a developer were prepared in the same way as Example 3 except that 2 parts of Nigrosine dye Bontrone N-04 was used in stead of Bontrone P-51 as charge controlling agent. After the 100,000-sheets copying test, there was noted no increase of the BKG level and the uniformity and density of the solid black of the copy were high, indicating an excellent durability of these toner and developer.

Example 9

A toner and a developer were prepared in the same way as Example 3 except that 2 parts of Nigrosine dye Bontrone N-09 was used in stead of Bontrone P-51 as charge controlling agent. After the 100,000-sheets copying test, there was noted no increase of the BKG level and the uniformity and density of the solid black of the copy were high, indicating an excellent durability of these toner and developer.

Comparative Example 1

A toner and a developer were prepared in the same way as Example 1 except that the powder of the compound (1) was not used, and they were subjected to the 100,000-sheets copying test.

As a result, there arose some serious problems such as excessive increase of the BKG level of the copy. Thus, this toner could not stand practical use.

Example 10

100 parts of styrene-n-butyl acrylate copolymer resin (styrene/n-butyl acrylate molar ratio=80/20), 2 parts of Viscol 550P (a low-molecular weight polypropylene, produced by Sanyo Chemical Co., Ltd.), 7 parts of carbon black MA-100 (Mitsubishi Kasei Corp.) and 2 parts of Bontrone S34 (a chrome-containing dye, produced by Orient Chemical Industries Co., Ltd.) were blended, kneaded, pulverized and classified to obtain a negatively charged black toner having an average particle size of about 12 μm.

To 100 parts of this black toner were externally added and mixed 0.2 parts of fine silica powder (R-972, produced by Nippon Aerosil Co., Ltd.) and 0.3 parts of fatty acid-treated powder of the compound (1) (BET specific surface area: 15 $m^2/g$; average secondary particle size: 0.2 μm) by a Henschel mixer.

3 parts of the thus-obtained toner and 97 parts of a ferrite carrier having an average particle size of 100 μm and coated with a silicone resin were mixed and stirred to form a developer.

This developer was subjected to a 20,000-sheet costing test by a copying machine. The charging characteristics were stabilized and the copy quality was high even after copying 20,000 sheets. Also, there took place little scatter of toner and substantially no increase of the BKG level during and after the copying test.

Example 11

A developer was prepared according to Example 10 except that the externally added amount of the compound (1) powder was changed to 0.1 part, and this developer was subjected to a practical copying test. The amount of charge was stabilized, there took place little scatter of toner and substantially no increase of the BKG level, and the copy quality stabilized in copying of up to 30,000 sheets.

Example 12

A developer was prepared by following the same procedure as Example 10 except that the amount of the compound (1) powder added was changed to 0.05 parts, and this developer was subjected to a copying test. There took place little scatter of toner and no increase of the BKG level, and the copy quality was stabilized in copying of up to 15,000 sheets.

Example 13

A developer was obtained in the same way as Example 10 except that polyester resin A (a polyester mainly composed of a Po adduct of bisphenol A and terephthalic acid) was used in place of styrene-n-butyl acrylate copolymer resin, and a copying test was conducted by using this developer. The charging characteristics were stabilized, there took place little scatter of toner and substantially no increase of the BKG level and the copy quality stabilized in copying of up to 30,000 sheets.

Comparative Example 2

A developer was prepared in the same way as Example 10 except that the compound (1) powder was not used, and this developer was subjected to a copying test.

The amount of charge decreased and the toner density rose as the number of copies increased. Also, the BKG level increased notably and the interior of the copying machine was made filthy with scattered toner to a notable degree after copying of 4,000 sheets.

Example 14

100 parts of styrene-n-butyl acrylate copolymer resin (flow softening point: 127° C.; glass transition point: 60° C.), 5 parts of carbon black MA-7 (Mitsubishi Kasei Corp.) used as colorant, 2 parts of Viscol 550P (polypropylene, produced by Sanyo Chemical Co., Ltd.) and 2 parts of Bontrone P51 (a quaternary ammonium salt, produced by Orient Chemical Co., Ltd.) used as charge controlling agent were blended, kneaded by using a continuous twin-screw extruder, then pulverized and classified to obtain a black toner having an average particle size of 8 μm. This black toner was used as base toner before external addition in the following Examples and Comparative Examples.

To 100 parts of the said black toner were externally added and mixed under stirring 0.2 parts of fine silica powder surface-treated with dimethyldichlorosilane (R-972, produced by Nippon Aerosil Co., Ltd., BET specific surface area=110 $m^2/g$) and 0.05 parts of fatty acid-treated (content: 3 parts based on 100 parts of the compound of the formula(I)) powder of the compound (1) (BET specific surface area=15 $m^2/g$) by a Henschel mixer to obtain a toner A.

4 parts of this toner A and 100 parts of a ferrite carrier having an average particle size of about 100 μm and coated with a silicone resin were mixed and stirred to form a starting developer A.

This developer A was subjected to (1) a copying test under normal environment (50,000-sheets copying test under the conditions of 25° C. and 60% RH); and (2) a copying test under low-temperature and low-humidity environment (50,000-sheets copying test under the conditions of 10° C. and 20% RH) by using a copying machine with a copying speed of 50 copies/min according to a blade cleaning system, using an organic photoconductor as photoreceptor. The supplementary toner used in the copying tests was the same toner as used for the preparation of the said starting developer.

(1) Results of the copying test under normal environment

From the start till copying of 50,000th sheet, the solid black of each copy had a high uniformity and free of chipping, and the image density was high and stabilized. Also, there was seen no increase of the BKG level of the copy, and further the interior of the copying machine had almost free of contamination by scattering of toner. Both the toner and the developer tested showed an excellent durability.

(2) Results of the copying test under low-temperature and low-humidity environment From the start to copying of 50,000th sheet, the density of the solid black of the copy was relatively stabilized and high, and there was seen no increase of the BKG level of the copy. Also, no contamination due to scattering of toner was observed in the interior of the copying machine.

The relation between developing potential and image density in the copying operation under normal environment (NN: 25° C. and 60% RH) and under low-temperature and low-humidity environment (LL: 10° C. and 20% RH) is shown in FIG. 1. There was noted no significant difference in such relation between the two cases.

Example 15

To 100 parts of the said black toner were externally added and mixed under stirring 0.15 parts of fine silica powder surface-treated with hexamethyldisilazane (R-812, produced by Nippon Aerosil Co., Ltd., BET specific surface area=280 $m^2/g$) and 0.05 parts of fatty acid-treated (content: 3 parts based on 100 parts of the compound of the formula (I)) powder of the compound (1) (BET specific surface area=15 $m^2/g$) by a Henschel mixer to obtain a toner B.

By using this toner B, a developer was prepared in the same way as Example 14, and the thus-obtained developer was subjected to the above-described tests (1) and (2). In the copying test under normal environment (25° C. & 60% RH) (test (1)), there were obtained the good results as in Example 14. Also, in the test (2), or the copying test under low-temperature and low-humidity environment (10° C. and 20% RH), the image density was maintained high and stable.

Example 16

To 100 parts of the black toner were externally added and mixed under stirring 0.20 parts of hexamethyldisilazane-treated silica powder (R-812, produced by Nippon Aerosil Co., Ltd.; BET specific surface area=280 $m^2/g$) and 0.1 part of fatty acid-treated (content: 3 parts based on 100 parts of the compound of the formula (I)) powder of the compound (1) (BET specific surface area=15 $m^2/g$) by a Henschel mixer to obtain a toner C.

By using this toner C, a starting developer was prepared in the same way as Example 14 and subjected to the above-described tests (1) and (2). In the copying test under normal environment (25° C. and 60% RH) (test (1)), there were obtained the good results similar to Example 14. Also, in the test under low-temperature and low-humidity environment (10° C. and 20% RH) (test (2)), the image density was maintained high and stable.

Example 17

To 100 parts of the black toner were externally added and mixed, under stirring, 0.20 parts of silica powder surface-treated with trichloromethylsilane (MT-10, produced by Tokuyama Soda Co., Ltd., BET specific surface area=120 $m^2/g$) and 0.05 parts of fatty acid-treated (content: 3 parts based on 100 parts of the compound of the formula (I)) powder of the compound (1) (BET specific surface area=15 $m^2/g$) by a Henschel mixer to obtain a toner D.

By using this toner D, a starting developer was prepared in the same way as Example 14 and subjected to the tests (1) and (2). In the normal environmental (25° C. and 60% RH) (test (1)), there were obtained the good results similar to Example 14. In the low-temperature and low humidity (10° C. and 20% RH) environmental (test (2)), the image density was maintained high and stable.

Comparative Example 3

To 100 parts of the black toner were externally added and mixed under stirring 0.2 parts of dimethyldichlorosilane-treated silica powder (R-972, produced by Nippon Aerosil Co., Ltd.; BET specific surface area=110 $m^2/g$) and 0.05 parts of fatty acid-treated (content: 3 parts based on 100 parts of the compound of the formula (I)) powder of a hydrotalcite compound $Mg_6Al_2(OH)_{13}CO_3.4H_2O$ (BET specific surface area=15 $m^2/g$) by a Henschel mixer to obtain a toner E.

By using this toner E, a starting developer was prepared in the same way as Example 14 and subjected to the tests (1) and (2). In the normal environmental (test (1)), there were obtained the good results substantially same as in Example 14, but in the low-temperature and low-humidity environmental (test (2)), the image density was rather low and there took place a large change of image density when the copying operation was resumed after long-time suspension of operation of the copying machine.

Figure 2:
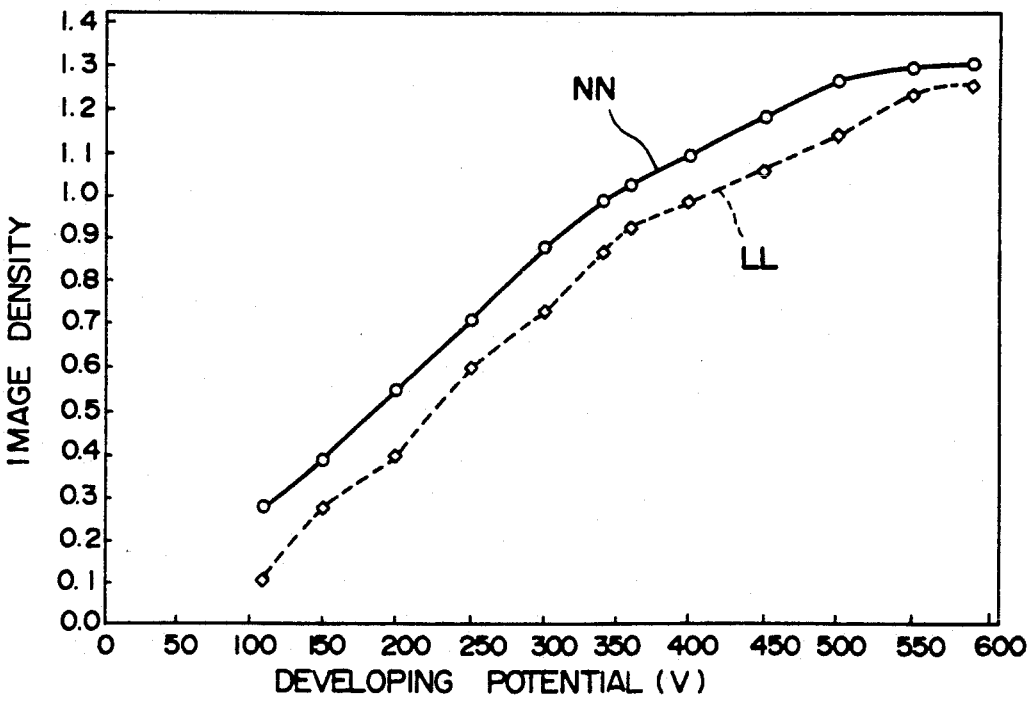
FIG. 2 is a graph showing the relation between developing potential and image density in use under a normal environment, and in use under a low temperature and low humidity environment in Comparative Example 3.

The relation between developing potential and image density in the copying operation under normal environment (NN: 25° C. and 60% RH) and under low-temperature and low-humidity environment (LL: 10° C. and 20% RH) is shown in FIG. 2. It is noted that the amount of change of image density is greater than in Example 14.

Comparative Example 4

To 100 parts of the black toner was externally added and mixed under stirring 0.2 parts of dimethyldichlorosilane-treated silica powder (R-972, produced by Nippon Aerosil Co., Ltd.; BET specific surface area=110 $m^2/g$) alone by a Henschel mixer to obtain a toner F.

By using this toner F, a starting developer was prepared in the same way as Example 14 and subjected to the tests (1) and (2). In the normal environmental (test (1)), the rests were almost as good as in Example 14, but the scattering of the toner was observed very much. In the low-temperature and low-humidity environmental (test (2)), the image density was rather low and there took place a large change of image density when the copying work was resumed after long-time suspension of operation of the copying machine. Also, some scattering of toner was observed.

Figure 3:
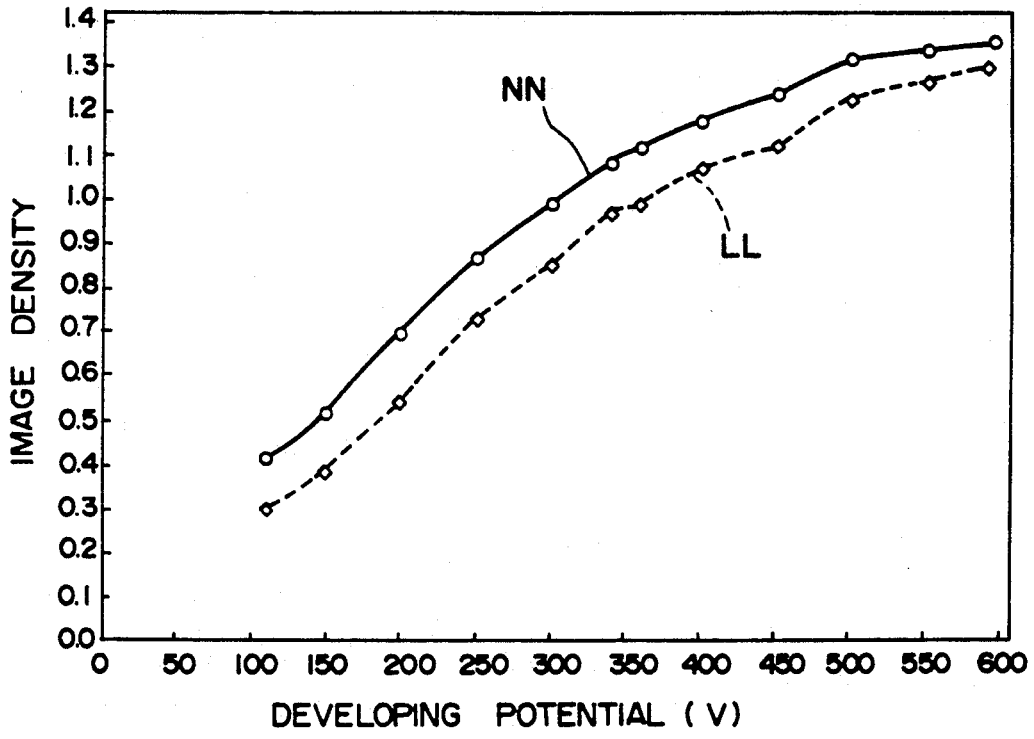
FIG. 3 is a graph showing the relation between developing potential and image density in use under a normal environment, and in use under a low temperature and low humidity environment in Comparative Example 4.

The relation between developing potential and image density in the copying operation under normal environment (NN: 25° C. and 60% RH) and under low-temperature and low-humidity (LL: 10° C. and 20% RH) is shown in FIG. 3. It is seen that the amount of change of image density is greater than in Example 14.

What is claimed is:

1. An electrostatic image-developing tonier comprising toner particles composed of at least a resin and a colorant, and powder of a compound represented by the following formula (I):

$$M^1y_1.M^2y_2.M^3x.(OH)_2.Ax/n.mH_2O \quad (I)$$

(wherein $M^1$ is at least one of the divalent metals selected from the group consisting of Mg, Ca, Sr and Ba; $M^2$ is at least one of the divalent metals selected from the group consisting of Zn, Cd, Pb and Sn; $M^3$ is a trivalent metal; A is an anion of n valency; x, $y_1$, $y_2$ and m are the positive numbers satisfying the relations of $0<x\leqq 0.5$, $y_1+y_2=1-x$ and $0\leqq m<2$).

2. A toner according to claim 1, wherein $M^3$ in the formula (I) is a trivalent metal selected from the group consisting of Al, Bi, In, Sb, B and Ti.

3. A toner according to claim 1, wherein A in the formula (I) is an anion of n valency selected from the group consisting of $CO_2^{2-}$, $OH^-$, $HCO_3^-$, salicylic acid ion$^-$, citric acid ion$^{3-}$, tartaric acid ion$^{2-}$, $NO_3^-$, $I^-$, $(OOC—COO)^{2-}$ and $(Fe(CN)_6)^{4-}$.

4. A toner according to claim 1, wherein the content of the powder of the compound represented by the formula (I) is 0.001-1 part by weight based on 100 parts by weight of the toner particles.

5. A toner according to claim 1, wherein the content of the colorant is 3-20 parts by weight based on 100 parts by weight of the binder resin in the toner precursor.

6. A toner according to claim 1, wherein $M^1$ in the formula (I) is Mg or Mg and Ca; $M^2$ in the formula (I) is Zn, Cd, Pb or Zn and Cd; $M^3$ in the formula (I) is Al; and A in the formula (I) is $CO_3^{2-}$or $OH^-$.

7. A toner according to claim 1, wherein the compound represented by the formula (I) is at least one of the compounds selected from the group consisting of:

$Mg_{0.5}Zn_{0.17}Al_{0.33}(OH)_2(CO_3)_{0.165}.0.45H_2O$, $Mg_{0.55}Zn_{0.15}Al_{0.3}(OH)_2(CO_3)_{0.15}$, $$Mg_{0.1}Ca_{0.3}Zn_{0.3}Al_{0.3}(OH)_2\begin{pmatrix}CHCOO\\ \|\\ CHCOO\end{pmatrix}_{0.15}.0.41H_2O,$$

$Mg_{0.6}Cd_{0.1}Al_{0.3}(OH)_2(CH_3COO)_{0.3}.0.34H_2O$, $Mg_{0.50}Pb_{0.20}Al_{0.30}(OH)_2(CO_3)_{0.15}.0.52H_2O$, $Mg_{0.50}Zn_{0.18}Al_{0.32}(OH)_2(CO_3)_{0.16}$, $Mg_{0.38}Zn_{0.30}Al_{0.32}(OH)_2(CO_3)_{0.16}.0.2H_2O$, $Mg_{0.60}Zn_{0.14}Al_{0.26}(OH)_2(CO_3)0.13$ $Mg_{0.60}Zn_{0.20}Al_{0.20}(OH)_2(CO_3)_{0.10}.0.6H_2O$ $Mg_{0.50}Zn_{0.20}Al_{0.30}(OH)_2(NO_3)_{0.30}$ $Mg_{0.5}Zn_{0.20}Al_{0.30}(OH)_2(OOCH{=}CHCOO)_{0.15}$ $Mg_{0.1}Ca_{0.4}Zn_{0.2}Al_{0.30}(OH)_{2.3}.0.25H_2O$ $Mg_{0.52}Zn_{0.16}Al_{0.32}(OH)_2(CO_3)_{0.16}.0.50H_2O$ $Mg_{0.48}Zn_{0.18}Al_{0.34}(OH)_2(CO_3)_{0.17}$ $Mg_{0.15}Ca_{0.4}Zn_{0.15}Al_{0.3}(OH)_{2.3}.0.2H_2O$ $Mg_{0.45}Zn_{0.23}Al_{0.32}(OH)_2(CO_3)0.16$ $Mg_{0.60}Zn_{0.16}Al_{0.24}(OH)_2(CO_3)0.12$ $Mg_{0.50}Zn_{0.25}Al_{0.25}(PH)_2(CO_3)_{0.125}$ $Mg_{0.48}Zn_{0.20}Al_{0.32}(OH)_2(CO_3)0.16$ $Mg_{0.5}Zn_{0.18}Al_{0.32}(OH)_2(CO_3)_{0.16}$ $Mg_{0.6}Zn_{0.2}Al_{0.2}(OH)_2(CO_3)_{0.1}$.

8. A toner according to claim 1, wherein $M^1$ in the formula(I) is Mg; $M^2$ in the formula (I) is Zn; $M^3$ in the formula (I) is Al; A in the formula (I) is $CO_3^{2-}$or $OH^-$; and m in the formula (I) is $0 \leqq m < 2$.

9. A toner according to claim 1, wherein the powder of the compound represented by the formula (I) has a BET specific surface area of 50 $m^2/g$ or less and an average secondary particle size of 5 μm or less.

10. A toner according to claim 1, wherein the powder of the compound represented by the formula (I) is one treated with a surface-treating agent selected from the group consisting of higher fatty acids, anionic surfactants, silane coupling agents, titanate coupling agents and esters of glycerin and fatty acids.

11. A toner according to claim 1, wherein the resin is one selected from the group consisting of styrene resins, vinyl chloride resin, rosin-modified maleic acid resin, phenol resin, epoxy resin, saturated or unsaturated polyester resin, polyethylene, polypropylene, ionomer resin, polyurethane, silicone resin, ketone resin, ethylene-ethyl acrylate copolymer, xylene resin, polyvinylbutyral and polycarbonate.

12. A toner according to claim 1, wherein the colorant is titanium oxide, zinc white, alumina white, calcium carbonate, prussian blue, carbon black, phthalocyanine blue, phthalocyanine green, Hansa Yellow G, Rhodamine dyes, Chrome Yellow, quinacridone, Benzidine Yellow, Rose Bengale, triallylmethane dyes, anthraquinone dyes, monoazo or diazo dyes, or a mixture thereof.

13. A toner according to claim 1, wherein said toner contains a charge controlling agent selected from the group consisting of quaternary ammonium salts, triphenylmethane compounds, Nigrosine dyes, and imidazole derivatives and metal complexes thereof.

14. A toner according to claim 1, wherein said toner contains a charge controlling agent selected from the group consisting of Cr- or Co-containing azo dyes, salicylic acid complex of Cr, Ar or Zn, and alkylsalicylic acid metal complexes of Cr, Ar or Zn.

15. A toner according to claim 1, wherein said toner contains an inorganic fine powder selected from the group consisting of silica, titanium and alumina powders, and having a BET specific surface area of 50-500 $m^2/g$.

16. A toner according to claim 15, wherein the inorganic fine powder is one hydrophobic-treated with silane coupling agents, titanate coupling agents, a higher fatty acid, anionic surface active agents or a silicone oil.

17. A toner according to claim 15, wherein the content of the inorganic fine powder is 0.005–7 parts by weight based on 100 parts by weight of the toner.

18. A developer comprising the developing toner defined in claim 1 and a carrier, the content of the developing toner being 1–10 parts by weight based on 100 parts by weight of the carrier.

19. A developer according to claim 18, wherein said carrier is a ferrite powder of which at least upper surface thereof is coated with a silicone-group resin.

* * * * *

UNITED STATES PATENT AND TRADEMARK OFFICE

CERTIFICATE OF CORRECTION

PATENT NO. : 5,244,764

DATED : SEPTEMBER 14, 1993

INVENTOR(S) : MIKIO UNO ET AL

It is certified that error appears in the above-indentified patent and that said Letters Patent is hereby corrected as shown below:

Column 8, line 24, delete "$Mg_{0.5}Zn_{0.20}Al_{0.30}(OH)_2(OOCH{=}CHCOO)_{0.15}$" and insert --$Mg_{0.5}Zn_{0.20}Al_{0.30}(OH)_2(OOCCH{=}CHCOO)_{0.15}$--;

line 37, delete "$Mg_{0.50}Zn_{0.25}AL_{0.25}(PH)_2(CO_3)_{0.125}$" and insert --$Mg_{0.50}Zn_{0.25}AL_{0.25}(OH)_2(CO_3)_{0.125}$--.

Column 17, line 25, delete "$CO_2^{2-}$" and insert --$CO_3^{2-}$--;

line 66, delete "$Mg_{0.5}Zn_{0.20}Al_{0.30}(OH)_2(OOCH{=}CHCOO)_{0.15}$" and insert --$Mg_{0.5}Zn_{0.20}Al_{0.30}(OH)_2(OOCCH{=}CHCOO)_{0.15}$--.

Column 18, line 11, delete "$Mg_{0.50}Zn_{0.25}AL_{0.25}(PH)_2(CO_3)_{0.125}$" and insert --$Mg_{0.50}Zn_{0.25}AL_{0.25}(OH)_2(CO_3)_{0.125}$--.

Signed and Sealed this

Twenty-fifth Day of April, 1995

Bruce Lehman

*Attest:*

BRUCE LEHMAN

*Attesting Officer*

*Commissioner of Patents and Trademarks*